US005713521A

United States Patent [19]

Scheffel

[11] Patent Number: 5,713,521

[45] Date of Patent: Feb. 3, 1998

[54] APPARATUS FOR INTERMITTENTLY ATOMIZING A FLUID

[76] Inventor: Bernd W. Scheffel, Ernst-Haeckel-Str. 71A, 80999 München, Germany

[21] Appl. No.: 511,243

[22] Filed: Aug. 4, 1995

[30] Foreign Application Priority Data

Jun. 26, 1995 [DE] Germany ..... 195 23 194.5

[51] Int. Cl.[6] ..... B05B 1/08

[52] U.S. Cl. ..... 239/99; 239/584

[58] Field of Search ..... 239/99, 569, 578, 239/583, 584

[56] References Cited

U.S. PATENT DOCUMENTS 2,453,377 11/1948 Lozivit .

FOREIGN PATENT DOCUMENTS 0030832 6/1981 European Pat. Off. .
0223435 5/1987 European Pat. Off. .
0514982 11/1992 European Pat. Off. .
929221 6/1946 France .

OTHER PUBLICATIONS

Europe Patent Application No. 246,370 –Our Washington Patent Service Co. was unable to locate the above referenced patent. (No additional info. available).

*Primary Examiner*—Lesley D. Morris
*Attorney, Agent, or Firm*—Robert W. Becker & Assoc.

[57] ABSTRACT

An apparatus for intermittently atomizing a fluid with the assistance of a gas or a mixture of gases. The apparatus includes a cylinder having a cylinder head with a valve seat and at least one flow passage, a piston driven within the cylinder by a rotating crankshaft, an injection valve having a valve head and a spring element urging the valve head into engagement with the valve seat to close the flow passage. The injection valve generally includes an actuating surface that cooperates with the piston to mechanically open the valve when the piston reaches the end of its compression stroke. As a result, the present invention delays the start of valve opening until the piston maximizes the atomizing pressure within the cylinder thereby advantageously maintaining small fluid drop sizes. Additionally, flow passages formed within or proximate to the valve head provide a corridor through which the cloud of drops enter the combustion chamber. Altering the size, shape and orientation of the flow passages allows the shape and direction of the cloud of drops protruding from the flow passage to be varied for different applications. Finally, the injection valve preferably includes mechanical guidance at both its axial ends to reduce edge stresses and increase the durability of the valve.

15 Claims, 2 Drawing Sheets

APPARATUS FOR INTERMITTENTLY ATOMIZING A FLUID

BACKGROUND OF THE INVENTION

The present invention relates to an apparatus for intermittently atomizing a fluid with the assistance of a gas or a mixture of gases. It has a cylinder piston arrangement and a crankshaft for driving the piston. The cylinder head has at least one aperture for the mixture of fluid and gas to be blown through. In this aperture, a mushroom type injection valve has a valve seat for the valve head. A spring keeps the valve head on the valve seat during a closed position.

When a mixture of water and air is atomized through an injection valve at a pressure level of about 80 psi the mean drop sizes can be found to be between 3 and 6 micrometers. An increase of the drop size appears at lower pressures. Since the preferred application of the invention is for fuel injection in combustion engines, the size of the drops and the distribution of the drops are critical for the completeness of the combustion and for the quality of the exhaust gases. The drops should be as small as possible and the protrusion of the cloud of drops should be sufficient. Spraying into a combustion chamber, it is especially advantageous if the cloud is shaped in a way that wall contact is avoided. If liquid fuel is atomized with air assistance and the pressure of the mixture of fuel and air becomes insufficient, power decreases and exhaust emissions are impaired. In this case the fuel drops are too large for perfect combustion and the protrusion of the cloud is too short for favorable distribution.

Existing devices having a cylinder piston arrangement as the pressure source for each injection valve produce a pressure up to 80 psi at upper dead center only if the injection valve is kept closed. The apparatus according to European patent application EP 0 514 982 A1 operates with much lower pressure during atomization. Because the opening of the valve is driven by the pressure of the fuel and air mixture, the start of the opening has to take place at low pressure. This is in order to obtain a sufficient open area in the time given. Therefore the atomization is of bad quality. Furthermore this device produces a drop distribution of cone shape which leads to wall contact of the drops. The result is imperfect combustion, causing high fuel consumption and impaired exhaust emissions. Another disadvantage of this device is the way the valve is guided. Its short guide length causes high edge stress. The way the spring is connected to the valve stem causes further reduction of durability. This connection contains a joint. However, at this position, with high impact load factor, a joint means a weak point and reduces the life time of the device.

It is an object of the present invention to improve an apparatus of the aforementioned general type in such a way that the atomizing pressure is higher, the protrusion of the spray jet is better and without wall contact, and durability of the device is high.

In order to produce late, fast and large lift of the valve, the valve is opened by mechanical positive control. The valve lift is caused directly by the piston. The piston hits the valve at the end of the compression stroke, opening it and leaves it at the return stroke, allowing the spring to close it. When the valve is closed, an actuating surface at the valve stem is reaching into the trajectory of the piston. Shortly before reaching upper dead center an actuating surface of the piston touches the actuating surface on the valve stem and moves it to upper dead center. This way, time and size of the lift can be defined precisely. The force of the spring is made high enough so that the valve can follow the piston on its return stroke. This method of opening the injection valve allows high gas pressure and greater passageway when the injection valve is opened.

Furthermore the invention discloses an optimal axial guidance of the valve, allowing high durability and good protrusion of the atomized fluid gas mixture. The valve is axially guided at its both ends. This allows large mechanical guide length with minimized edge stress and good flow guidance for the fluid gas mixture at the protrusion point to the chamber of lower pressure. Therefore, the apparatus according to the invention is characterized by high atomizing pressure and advantageous shape of the spray jet as well as improved durability.

Further advantageous details of the invention are described subsequently. Because the valve head is part of the mechanical guidance, there need to be apertures for the flow. These apertures can be produced in an easy way by the presence of axial grooves in the circumference of the valve head or in the bore surrounding it. These grooves are covered by the mechanical guidance and control the spray jet mainly parallel to the valve axis. This way the spray jet avoids wall contact and obtains high protrusion.

The guidance at the stem end of the valve can be obtained by force or by mechanical guide or by a mixture of both. The simplest form of a mechanical guidance is a guide bore for the valve stem end piece. In this case concentric apertures for the flow are required. However such a guide bore can as well be omitted. In this case the piston will act as guide. The piston itself is guided by the cylinder. If the piston is in positive connection with the injection valve during the common travel it can act as guide for the valve. Especially useful for positive connection surfaces are spheric surfaces at the valve and the piston. A special radius of the spheres guarantees the fitting of the concave and the convex spheric surfaces even if the valve would slightly pivot around its other guidance at the valve head.

A guidance by force can be obtained if the spring offers sufficient radial stiffness to keep the valve end in co-axial position.

If the valve seat and the sealing surface on the valve head are both spherically shaped, the sealing function of the valve will be guaranteed even if the valve axis is slightly pivoted. In this case as well, it is advantageous for the spheric center to be in the range within the possible pivoting point of the valve. According to the invention, the injection valve, having no guidance within the area of the valve stem, allows the manufacturing of the valve as one single part completely without joints. For assembly it can be put through the bore in the valve seat and inserted into the spring. These features avoid stress and notches which usually reduce the durability of joints.

BRIEF DESCRIPTION OF THE DRAWINGS

This object, and other objects of the present invention, will appear more dearly in the following specification in conjunction with the accompanying schematic drawings, in which.

SUMMARY OF THE INVENTION

The present invention is characterized primarily by high atomizing pressure and ideal protrusion of the spray jet. This is achieved by having the piston control the injection valve opening and having a valve guidance at each of its axial ends. Shortly before upper dead center, the piston pushes on the valve, opening it. When the piston retracts, a spring returns the valve to its closed position.

This valve guidance allows efficient flow through the valve arrangement to the apertures at the valve head guidance. There the spray jet leaves the apertures with good axial protrusion into the chamber of lower pressure.

DESCRIPTION OF PREFERRED EMBODIMENTS

Figure 1:
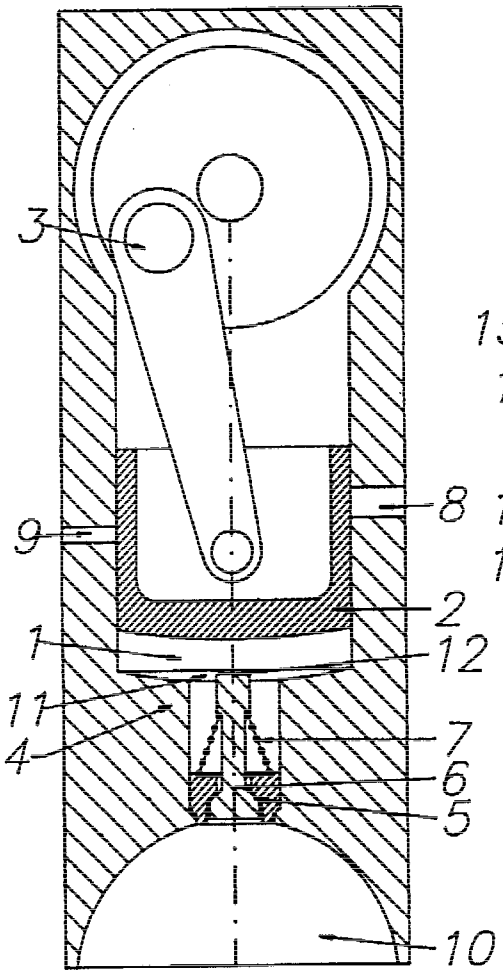
FIG. 1 is a cross-sectional view through one exemplary embodiment of the inventive apparatus for intermittently atomizing a fluid with the assistance of a gas.

Referring now to the drawings in detail, the main elements of the apparatus for atomizing a fluid are shown in FIG. 1, as there are the cylinder 1, the piston 2 and the crankshaft 3, the cylinder head 4 containing the valve seat 5, the valve 6 and the spring 7. Possible embodiments for the gas inlet 8 and the fluid inlet 9 are shown on cylinder 1. Piston 2, which is driven by the rotating crankshaft 3 is intermittently compressing the mixture of fluid and gas formed through the inlets. In the region of maximal compression the injection valve 6 is opened by the piston 2 and the mixture is atomized and projected to the chamber 10 of lower pressure. Preceding the next compression the cylinder 1 will be filled again and the cycle will be repeated.

Figure 2:
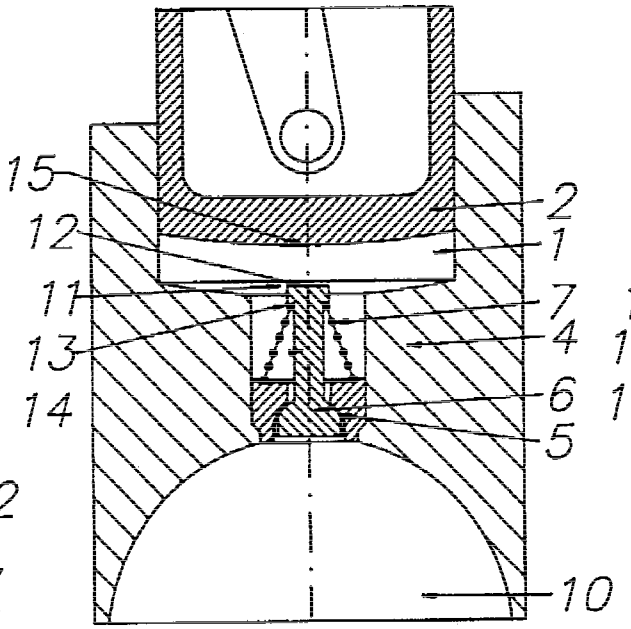
FIG. 2 is a cross-sectional view through the cylinder head with an aperture and an injection valve in a closed position.

In FIG. 2 can be seen: the cylinder 1 and the piston 2 on its travel to its dead center 11 of highest compression, the cylinder head 4, the valve seat 5, the injection valve 6 and the spring 7. The piston 2 is not yet at its dead center 11 and has not yet touched the injection valve 6. The injection valve 6 is being held at its valve seat 5 by the force of the spring 7. While the injection valve 6 is being closed the pressure rises in the cylinder 1.

Figure 3:
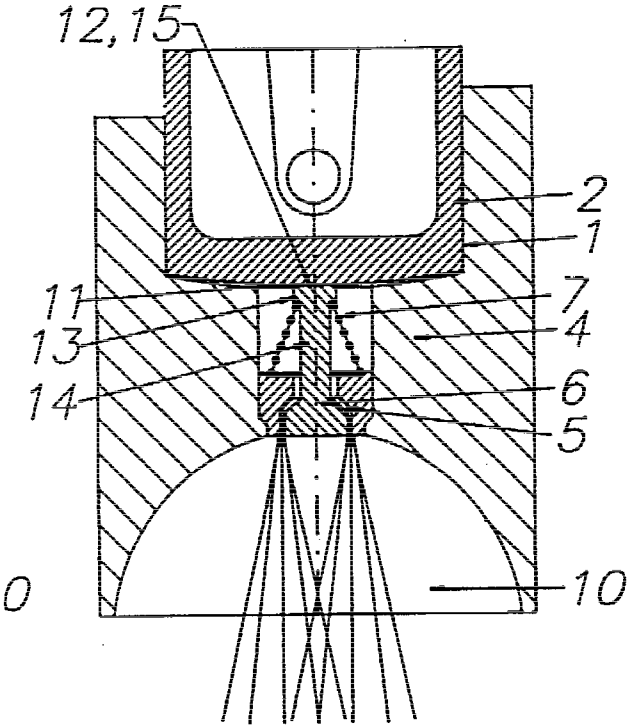
FIG. 3 is a cross-sectional view through the cylinder head with an aperture and an injection valve in an open position.

In FIG. 3 the piston 2 has arrived at its dead center 11. Shortly before that, it has touched the actuating surface 12 on the injection valve 6 and from there the valve has participated in the pistons stroke. The injection valve 6 has been lifted off the valve seat 5 and the flow of the fluid-gas-mixture is entering the chamber 10 of lower pressure.

Figure 4:
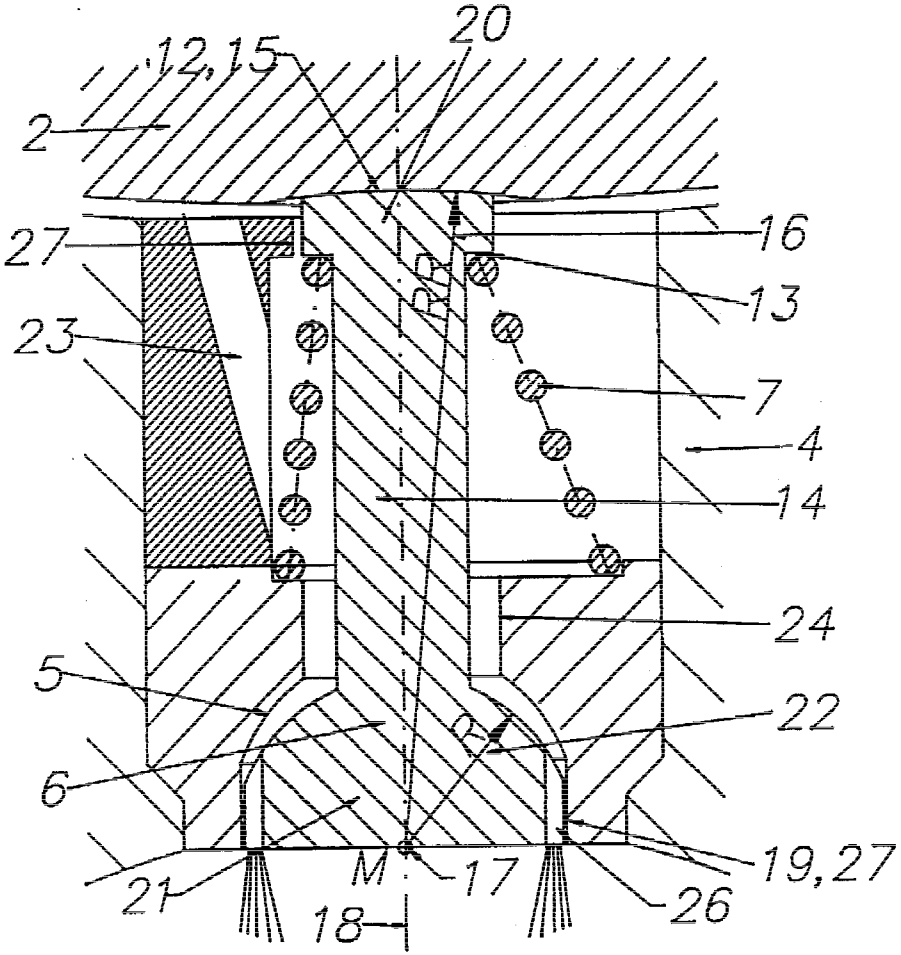
FIG. 4 is a cross-sectional view through the injection valve.

A special embodiment of the injection valve 6 is shown in FIG. 4, which shows the open position. The force of the spring 7 is pressing the injection valve 6 towards the piston 2. The spring 7 is resting upon the protrusion 13 of the valve stem 14. The actuating surface 12 at the end of valve stem 14 is spheric convex with the radius RR 16 and the adjoining surface 15 at the piston 2 is spheric concave and has also the radius RR 16. The spheric center is located at the center 17 of the valve head guidance 19. This radius RR 16 guarantees an advantageous load of the surfaces even if the injection valve 6 is slightly pivoted out of its standard position.

The valve seat 5 and the valve head 21 will be equally unaffected by pivoting, if both of them are spheric and have a special radius R 22. In this case the valve head 21 is convex and the valve seat 5 is concave. The center M 17 of the sphere is located at the center of the valve head guidance 19.

The complete injection valve 6 is preferably manufactured as a single part. During assembly the valve stem 14 with its actuating surface 12 can be inserted through the concentric bore 24 in the valve seat 5.

The valve head 21 has grooves 26 in the circumferential area of the guidance 27, which allows the flow to pass through. These grooves 26 may be shaped in different ways in order to obtain the most favorable projection of the flow. For example the sectional area of the grooves or their direction can be varied.

An alternative guidance 27 for the valve end 20 is shown in FIG. 4 on the left side. In this case additional apertures 23 for the flow are necessary.

Figure 6:
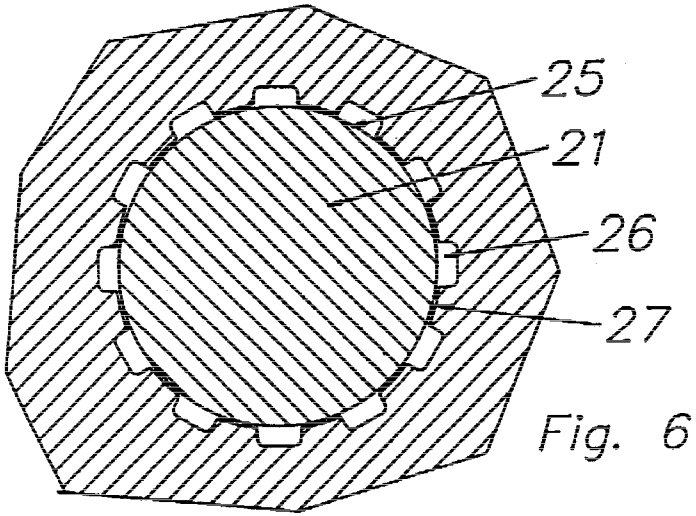
FIG. 6 is a cross-sectional view through the valve head.
Figure 5:
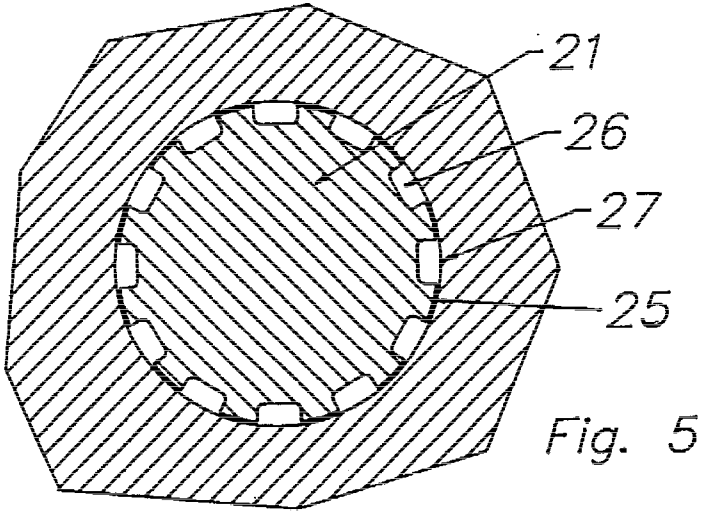
FIG. 5 is a cross-sectional view through the valve head.

FIG. 5 a cross-sectional view through the valve head, shows an example for an embodiment of the grooves 26. An alternative is shown in FIG. 6. Here the circumference 25 of the valve head 21 has no grooves, if they are positioned in the guide bore 27. The grooves 26 permit a number of variations in terms of shape, size and direction of the protruding flow.

A preferred application of the invention is for fuel injection in combustion engines. In this case the drive of the piston 2 is synchronized with the combustion engine. The present invention is, of course, in no way restricted to the specific disclosure of the specification and drawings, but also encompasses any modifications within the scope of the appended claims.

What I claim is:

1. An apparatus for intermittently atomizing a fluid with the assistance of air, comprising:

a cylinder adapted to periodically receive fluid and air;

a piston displaceably disposed in said cylinder for compressing a mixture of fluid and air;

a cylinder head having at least one aperture defining a flow passage for conveying said mixture of fluid and air to a chamber, said flow passage being surrounded by a valve seat formed in said cylinder head; and an injection valve disposed in said cylinder head and being biased by a spring that urges a cooperating seating surface of a valve head of said injection valve against said valve seat for closing off said flow passage, said injection valve having a valve stem connected to said valve head and on an end thereof remote from said valve head an actuating surface that extends into a path of travel of said piston when said injection valve is in a closed position, said flow passage being large enough to permit passage therethrough, during assembly, of said valve stem and said actuating surface thereof.

2. An apparatus according to claim 1, having a mechanical positive guidance of the injection valve at the circumference of the valve head.

3. An apparatus according to claim 2, wherein said valve head includes apertures formed in the valve head in the region of the guidance, said apertures defining further flow passages.

4. An apparatus according to claim 2, wherein said mechanical positive guidance includes a guide bore having apertures defining further flow passages in the region of the guidance.

5. An apparatus according to claim 4, with said valve seat and said cooperating seating surface of said valve head having spheric surfaces of substantially equal spheric radius.

6. An apparatus according to claim 1, with said injection valve being one single part and having a protrusion, from that end of said valve stem on which said activating surface is formed, cooperative with the spring.

7. An apparatus according to claim 1, wherein said injection valve further includes axial ends and guidance associated with both regions of said axial ends.

8. An apparatus according to claim 1, wherein said injection valve is one single part.

9. An apparatus according to claim 8, wherein said spring cooperates with that end of said valve stem on which said actuating surface is formed to provide guidance for said injection valve.

10. An apparatus according to claim 8, wherein said actuating surface of the injection valve is convex and an actuating surface at the piston is concave thereby providing a positive mechanical guidance by said piston of the injection valve at that end of said valve stem on which said actuating surface is formed.

11. An apparatus according to claim 10, wherein said actuating surface of the injection valve and said actuating surface of the piston are spheric and have substantially the same radius.

12. An apparatus according to claim 11, wherein a spheric center of said spherical activating surfaces is located approximately at the center of guide means of the valve head.

13. An apparatus according to claim 12, with said valve seat and said cooperating seating surface of said valve head having spheric surfaces of substantially equal spheric radius.

14. An apparatus according to claim 13, wherein the spherical surface of said valve head and the actuating surface of said valve head have substantially the same spherical center.

15. An apparatus according to claim 13, wherein a spheric center of said valve head is located approximately in the center of guide means of the valve head.

* * * * *